US010876232B2

(12) United States Patent
Nishigaki

(10) Patent No.: US 10,876,232 B2
(45) Date of Patent: Dec. 29, 2020

(54) SOCK

(71) Applicant: Nishigaki Socks Co., Ltd., Yamatotakada (JP)

(72) Inventor: Kazutoshi Nishigaki, Yamatotakada (JP)

(73) Assignee: NISHIGAKI SOCKS CO., LTD., Nara (JP)

( * ) Notice: Subject to any disclaimer, the term of this patent is extended or adjusted under 35 U.S.C. 154(b) by 59 days.

(21) Appl. No.: 16/195,979

(22) Filed: Nov. 20, 2018

(65) Prior Publication Data

US 2019/0153639 A1 May 23, 2019

(30) Foreign Application Priority Data

Nov. 20, 2017 (JP) ..... 2017-223216

(51) Int. Cl.
*D04B 1/26* (2006.01)
*D04B 1/04* (2006.01)
(Continued)

(52) U.S. Cl.
CPC ..... *D04B 1/26* (2013.01); *A41B 11/003* (2013.01); *D04B 1/04* (2013.01); *D04B 1/102* (2013.01);
(Continued)

(58) Field of Classification Search
CPC ..... D04B 1/26; D04B 1/265; D04B 1/102; D04B 1/04; D04B 1/108; D04B 9/48;
(Continued)

(56) References Cited

U.S. PATENT DOCUMENTS 3,561,441 A * 2/1971 Lombardi ..... A61F 13/00017 602/44
4,263,793 A * 4/1981 Safrit ..... A41B 11/02 2/239
(Continued)

FOREIGN PATENT DOCUMENTS

JP 2013-014865 A 1/2013

OTHER PUBLICATIONS

"Polyester Vs. Polyether: What's the Difference?—PSI Urethanes." PSI Urethanes: Custom Molded Polyurethane Products—Cast Urethane Manufacturer, Aug. 23, 2016, psiurethanes.com/urethane-resources/polyester-vs-polyether-whats-the-difference/. (Year: 2016).*

*Primary Examiner* — Khoa D Huynh
*Assistant Examiner* — Grace Huang
(74) *Attorney, Agent, or Firm* — Pearne & Gordon LLP

(57) ABSTRACT

A conventional sock, in which a pile yarn knitted into loops together with a polyurethane yarn has cushioning properties, but has a problem in that it cannot be used for a long period of time. According to the present invention, a first component yarn 15*a* composed of two yarns, namely, a woolly nylon yarn 13*a* and a cotton yarn 14*a*, and a second component yarn 15*b* composed of two yarns, namely, a woolly nylon yarn 13*b* and a cotton yarn 14*b*, are alternately knitted into float loops every 10 loops. Accordingly, the cotton yarns that are less stretchable appear on the surface, and thus cushioning properties can be improved. Also, the yarn strength can be increased by the woolly nylon yarns that are highly stretchable, and also the strength can be further increased by using the component yarns each composed of two yarns: a woolly nylon yarn; and a cotton yarn. Accordingly, the obtained sock can be used for a long period of time.

7 Claims, 9 Drawing Sheets

(51) Int. Cl.

| | |
|---|---|
| ***A41B 11/00*** | (2006.01) |
| ***D04B 11/28*** | (2006.01) |
| ***D04B 11/34*** | (2006.01) |
| ***D04B 1/10*** | (2006.01) |
| *D04B 9/56* | (2006.01) |

(52) U.S. Cl.
CPC ..... *D04B 11/28* (2013.01); *D04B 11/34* (2013.01); *D04B 9/56* (2013.01); *D10B 2201/00* (2013.01); *D10B 2201/02* (2013.01); *D10B 2201/24* (2013.01); *D10B 2211/00* (2013.01); *D10B 2211/04* (2013.01); *D10B 2321/08* (2013.01); *D10B 2331/02* (2013.01); *D10B 2331/04* (2013.01); *D10B 2331/10* (2013.01); *D10B 2403/0241* (2013.01)

(58) Field of Classification Search
CPC ... D04B 9/50; D04B 9/52; D04B 9/54; D04B 9/56; D04B 11/28; D04B 11/30; D04B 11/32; D04B 11/34; A41B 11/003; D10B 2201/00; D10B 2201/02; D10B 2201/04; D10B 2211/00; D10B 2211/04; D10B 2331/02; D10B 2331/04; D10B 2331/10; D10B 2321/08; D10B 2403/0241
USPC ..... 66/183, 184, 185, 186, 187, 188
See application file for complete search history.

(56) References Cited

U.S. PATENT DOCUMENTS 4,589,267 A * 5/1986 Barbee ..... C10G 47/16 66/12
4,672,825 A * 6/1987 Yasukawa ..... D04B 1/04 66/194
5,319,950 A * 6/1994 Whitt ..... A41B 11/02 66/182
5,724,836 A * 3/1998 Green ..... D04B 1/02 66/185
6,082,146 A * 7/2000 Dahlgren ..... A41B 11/003 2/239
7,677,061 B2 * 3/2010 Mori ..... D04B 9/12 66/185
8,535,776 B2 * 9/2013 Erickson ..... B32B 5/026 428/95
8,973,411 B2 * 3/2015 Gaither ..... A61F 13/08 66/182
9,192,200 B2 * 11/2015 Matsuo ..... A41D 13/06
9,498,003 B2 * 11/2016 Cherneski ..... D06N 7/0092
10,167,579 B2 * 1/2019 Kilickan ..... D03D 15/0061
2006/0144097 A1 * 7/2006 Langer ..... A41B 11/00 66/178 R
2009/0223254 A1 * 9/2009 Ishida ..... D04B 1/26 66/185
2012/0255643 A1 * 10/2012 Duan ..... D04B 21/04 139/396
2012/0284902 A1 * 11/2012 Matsuo ..... A41B 11/02 2/239
2014/0053610 A1 * 2/2014 Fukui ..... D04B 1/102 66/183
2015/0322598 A1 * 11/2015 Stanhope ..... D03D 27/08 428/91
2017/0079868 A1 * 3/2017 Reid, Jr. ..... A61B 5/0053
2018/0002839 A1 * 1/2018 Liao ..... D02G 3/32

* cited by examiner

--PRIOR ART--

SOCK

BACKGROUND OF THE INVENTION

Field of the Invention

The present invention relates to a sock in which a woolly-processed yarn is knitted into loops into a plurality of loops formed by a ground yarn knitted into loops.

Description of the Related Art

Conventionally, a sock is known in which a pile yarn is knitted into loops into a plurality of loops formed by a ground yarn knitted into loops. In this type of sock, a pile yarn 103 and a polyurethane bare yarn 104 are knitted so as to form loops extending upward (toward the inner side of the sock) in FIG. 9 between loops of a ground yarn 102, and the polyurethane bare yarn 104 is knitted so as to also form loops having a length H on the outer side of the sock. As a result of the pile yarn 103 and the polyurethane bare yarn 104 being knitted so as to form loops extending toward the inner side of the sock, cushioning properties are improved, and the contact area between a foot and the sock increases, which increases the frictional resistance between the foot and the sock, and produces an advantageous effect of preventing the sock from slipping out of position. Also, because the polyurethane bare yarn 104 protrudes on the outer side of the sock, an advantageous effect of further preventing the sock from slipping on a shoe, a floor or the like is also produced (see, for example, JP 2013-14865A). Here, FIG. 9 is a diagram showing the formation of a conventional sock.

JP 2013-14865A is an example of related art.

However, although cushioning properties are improved by knitting a pile yarn and a polyurethane bare yarn into loops, the conventional sock is problematic in that, with stitches formed by knitting the pile yarn and the polyurethane bare yarn into loops, a fabric made of the pile yarn becomes loose, which increases friction between the pile yarn and a contact area, causing damage to the pile yarn, and thus the sock cannot be used for a long period of time. In particular, socks with cushioning properties are required by people who work in factories in order to reduce fatigue from hard work, but use of a sock produced by knitting a pile yarn and a polyurethane bare yarn into loops in factories is often avoided because it cannot be used for a long period of time.

SUMMARY OF THE INVENTION

The present invention has been made in view of the problem described above, and it is an object of the present invention to provide a sock that has improved cushioning properties and can be used for a long period of time.

In order to solve the above problem and achieve the above object, a first aspect of the present invention relates to a sock in which a woolly-processed yarn is knitted into loops into a plurality of loops formed by a ground yarn knitted into loops, wherein a sock bottom portion is knitted such that two pairs of component yarns are alternately knitted into float loops every plurality of loops into the plurality of loops formed by the ground yarn knitted into loops, the two pairs of component yarns being a first component yarn and a second component yarn that are each composed of two yarns: a yarn made from a woolly-processed yarn; and a yarn made from a cellulose fiber yarn, a hemp yarn, a silk yarn, animal hair, or an acrylic yarn According to the present invention, two pairs of component yarns are alternately knitted into float loops every plurality of loops, the two pairs of component yarns being a first component yarn and a second component yarn that are each composed of two yarns: a yarn made from a woolly-processed yarn; and a yarn made from a cellulose fiber yarn, a hemp yarn, a silk yarn, animal hair, or an acrylic yarn. Accordingly, the less stretchable yarn made from a cellulose fiber yarn, a hemp yarn, a silk yarn, animal hair, or an acrylic yarn appears on the surface, and thus cushioning properties can be improved. Also, the yarn strength can be increased by the highly stretchable yarn made from a woolly-processed yarn, and also the strength can be further increased by using the component yarns each composed of two yarns: a yarn made from a woolly nylon yarn; and a yarn made from a cellulose fiber yarn, a hemp yarn, a silk yarn, animal hair, or an acrylic yarn. Accordingly, the sock can be used for a long period of time. As described above, according to the present invention, the sock can exhibit cushioning properties obtained by performing pile knitting in a region that is not pile knitted, and thus can be used for a long period of time even when the sock is used by a factory worker or the like.

A second aspect of the present invention relates to the sock according to the first aspect, wherein the first component yarn and the second component yarn are alternately knitted into float loops every 10 loops.

According to the present invention, the first component yarn and the second component yarn are alternately knitted into float loops every 10 loops. Accordingly, the less stretchable yarn made from a cellulose fiber yarn, a hemp yarn, a silk yarn, animal hair, or an acrylic yarn appears on the surface, and thus cushioning properties can be improved. Also, the yarn strength can be increased by the highly stretchable yarn made from a woolly-processed yarn, and also the strength can be further increased by using the component yarns each composed of two yarns: a yarn made from a woolly-processed yarn; and a yarn made from a cellulose fiber yarn, a hemp yarn, a silk yarn, animal hair, or an acrylic yarn. Accordingly, the sock can be used for a long period of time even when the sock is used by a factory worker or the like.

A third aspect of the present invention relates to the sock according to the second aspect, wherein the first component yarn and the second component yarn are knitted with an offset of 5 loops every predetermined number of courses.

According to the present invention, the first component yarn and the second component yarn are knitted with an offset of 5 loops every predetermined number of courses, and thus lower portions of stitches on the sock surface are flattened as a result of being knitted with an offset of 5 loops every predetermined number of courses. Accordingly, the lower portions of stitches on the sock surface are not conspicuous, and thus the cushioning properties of the sock bottom portion can be improved more uniformly.

A fourth aspect of the present invention relates to the sock according to the first aspect, wherein the cellulose fiber yarn is a cotton yarn.

A fifth aspect of the present invention relates to the sock according to the first aspect, wherein the cellulose fiber yarn is a viscose rayon fiber or a cuprammonium rayon fiber.

A sixth aspect of the present invention relates to the sock according to the first aspect, wherein the woolly-processed yarn is a woolly nylon yarn or a polyester yarn.

A seventh aspect of the present invention relates to the sock according to the second aspect, wherein the woolly-processed yarn is disconnected at a portion of a floating portion.

According to the present invention, the woolly-processed yarn is disconnected at a portion of a floating portion. Accordingly, the woolly-processed yarn can be more easily intertwined with the yarn made from a cellulose fiber yarn, a hemp yarn, a silk yarn, animal hair, or an acrylic yarn, and it is possible to further prevent the yarn made from a cellulose fiber yarn, a hemp yarn, a silk yarn, animal hair, or an acrylic yarn from being pulled to the outside of the sock.

An eighth aspect of the present invention relates to the sock according to any one of the first to seventh aspects, wherein a ball-of-foot portion is knitted through plain knitting in which only a rubber-based fiber yarn is knitted into the plurality of loops formed by the ground yarn knitted into loops.

According to the present invention, the ball-of-foot portion of the sock is plain knitted using a rubber-based fiber yarn. Accordingly, the rubber-based fiber yarn on the outer surface of the sock prevents the sock from slipping on a shoe or the like. In addition thereto, because plain knitting is used in which the loop length of the rubber-based fiber yarn is substantially the same length as that of the ground yarn, the rubber-based fiber yarn does not protrude too long in length toward the outside of the sock, and a good appearance can be obtained.

A ninth aspect of the present invention relates to the sock according to the eighth aspect, wherein the rubber-based fiber yarn is a polyurethane yarn.

According to the present invention, two pairs of component yarns are alternately knitted into float loops every plurality of loops, the two pairs of component yarns being a first component yarn and a second component yarn that are each composed of two yarns: a yarn made from a woolly-processed yarn; and a yarn made from a cellulose fiber yarn, a hemp yarn, a silk yarn, animal hair, or an acrylic yarn. It is therefore possible to improve the cushioning properties, and the sock can be used for a long period of time even when the sock is used by a factory worker or the like.

BRIEF DESCRIPTION OF THE DRAWINGS

FIG. 4(*b*) is a diagram showing a float boundary portion in the float knitted fabric of the sock.

DESCRIPTION OF THE EMBODIMENTS

Figure 1:
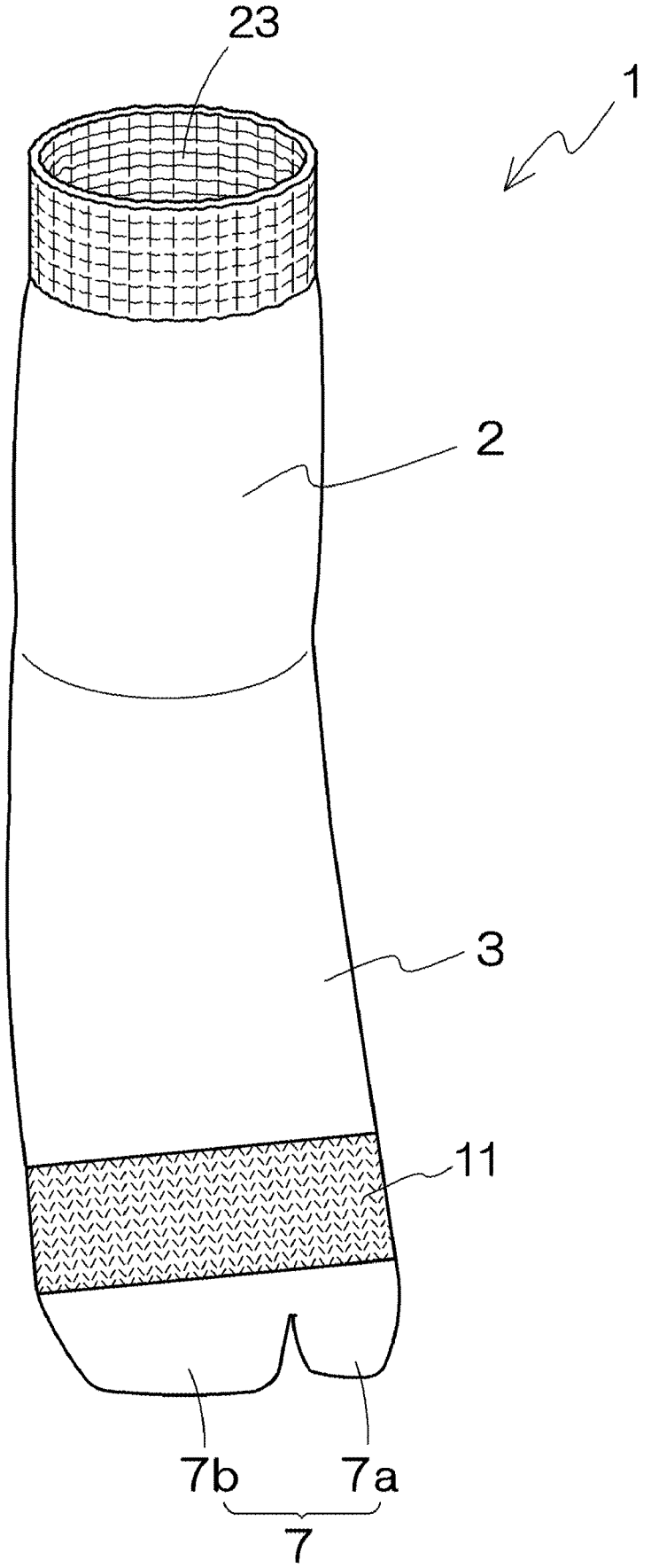
FIG. 1 is a top right perspective view of a sock according to an embodiment of the present invention.

Hereinafter, a sock according to a first embodiment of the present invention will be described with reference to the drawings. FIG. 1 is a top right perspective view of a sock according to an embodiment of the present invention, and FIG. 2 is a bottom left perspective view of the sock.

As shown in FIG. 1, a sock 1 includes a leg portion 2, an instep portion 3, a heel portion 4 (see FIG. 2), an arch portion 5 (see FIG. 2), a ball-of-foot portion 6 (see FIG. 2), a toe portion 7, and the like. The toe portion 7 includes a big toe sheath portion 7*a* for housing the big toe, and an outer toe sheath portion 7*b* for housing the remaining toes. In the present embodiment, the big toe sheath portion 7*a* for accommodating the big toe, and the outer toe sheath portion 7*b* for accommodating the remaining toes are formed in the toe portion 7, but the configuration is not limited thereto. It is also possible to form five sheath portions to accommodate each of the five toes.

Figure 2:
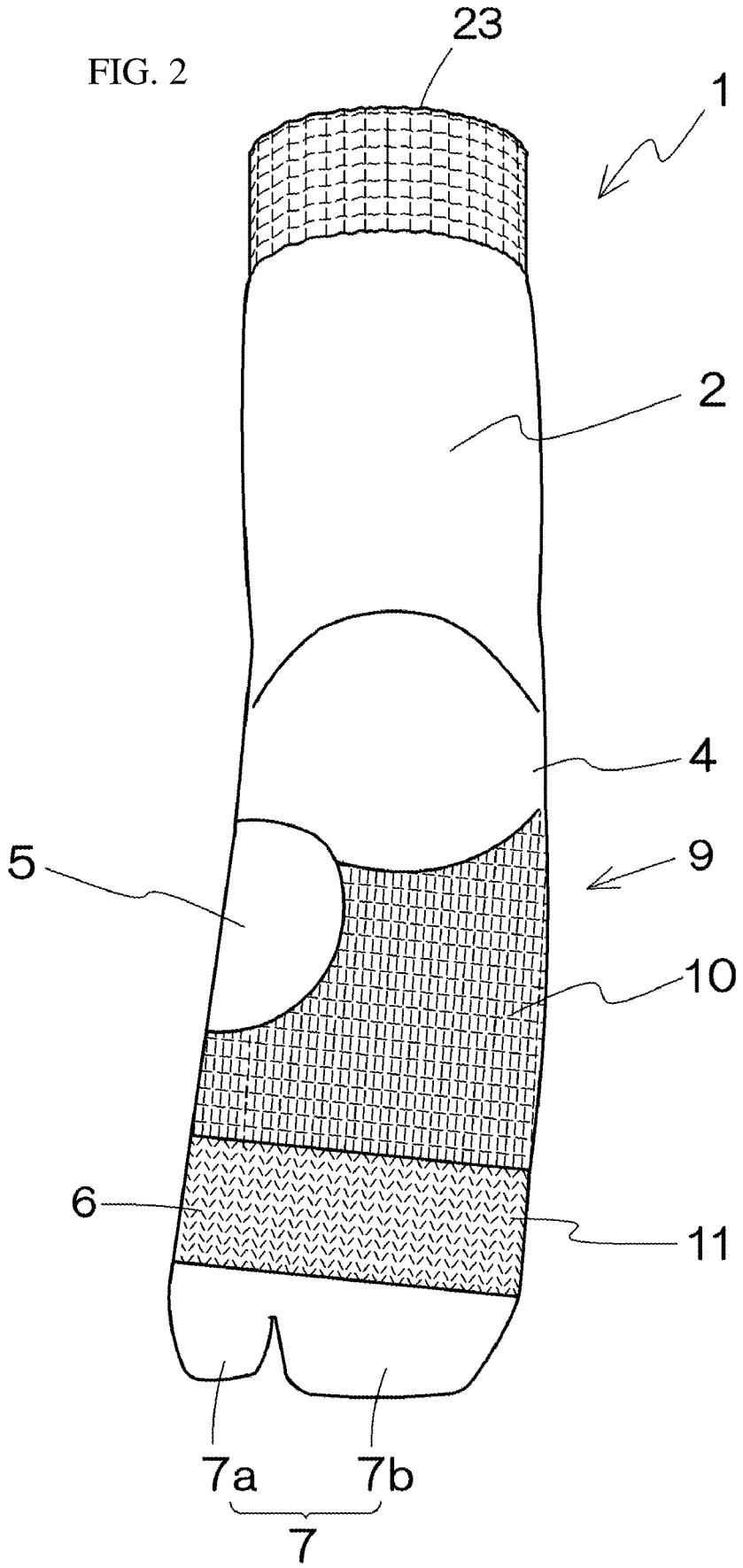
FIG. 2 is a bottom left perspective view of the sock.

As shown in FIG. 2, a sole cushioning portion 10 is formed in a sock bottom portion 9. In the present embodiment, the sole cushioning portion 10 is formed in a region of the sock bottom portion 9 other than the heel portion 4, the arch portion 5, the toe portion 7, and a slip preventing forefoot portion 11, which will be described later. However, the sole cushioning portion 10 may be formed in the entire sock bottom portion 9. The sole cushioning portion 10 may be formed entirely or partially in the entire sock bottom portion 9 as long as the sole cushioning portion 10 is formed in the sock bottom portion 9. As will be described later, in the sole cushioning portion 10, a first component yarn 15*a* composed of two yarns, namely, a yarn made from a woolly nylon yarn 13*a* and a yarn made from a cotton yarn 14*a*, and a second component yarn 15*b* composed of two yarns, namely, a yarn made from a woolly nylon yarn 13*b* and a yarn made from a cotton yarn 14*b* are knitted into float loops alternately every 10 loops into a plurality of loops formed by a ground yarn 12 knitted into loops (see FIG. 4). Hereinafter, the term "yarn made from a woolly nylon yarn" will be referred to as "woolly nylon yarn", and the term "yarn made from a cotton yarn" will be referred to as "cotton yarn". Also, in the present embodiment, woolly nylon yarns 13*a* and 13*b* are used as the woolly-processed yarns, but the woolly-processed yarns are not limited thereto. It is also possible to use other woolly-processed yarns such as polyester yarns. Also, in the present embodiment, cotton yarns 14*a* and 14*b* are used as the cellulose fiber yarns, but the cellulose fiber yarns are not limited thereto. It is also possible to use natural cellulose fiber yarns other than the cotton yarns 14*a* and 14*b*, regenerated cellulose fiber yarns such as viscose rayon fibers, cuprammonium rayon fibers, or yarns other than the cellulose fiber yarns such as hemp yarns, silk yarns, animal hair, and acrylic yarns.

Also, the slip preventing forefoot portion 11 is formed in the ball-of-foot portion 6. In FIGS. 1 and 2, the slip preventing forefoot portion 11 is formed in a foot circumference direction so as to include the ball-of-foot portion 6, but it is sufficient that the slip preventing forefoot portion 11 is formed in the ball-of-foot portion 6. As will be described later, the slip preventing forefoot portion 11 is knitted by plain knitting a polyurethane yarn 16 into a plurality of loops formed by the ground yarn 12 knitted into loops (see FIG. 3). Here, in the slip preventing forefoot portion 11 of the present embodiment, a woolly nylon yarn and a cotton yarn are not used. The reason that the slip preventing forefoot portion 11 including the ball-of-foot portion 6 is knitted by plain knitting a polyurethane yarn 16 as described above is that the ball-of-foot portion 6 generates a large amount of friction with a shoe, a floor or the like, and thus if the slip preventing forefoot portion 11 is knitted through loop knitting in which the sinker loop length of the polyurethane yarn 16 is longer than the sinker loop length of the ground yarn, the amount of polyurethane yarn 16 pulled out of the outer surface of the sock 1 increases. In the present embodiment, polyurethane yarn 16 is used, but the yarn used to knit the slip preventing forefoot portion 11 is not limited thereto. It is also possible to use other rubber-based fiber yarns.

Figure 3:
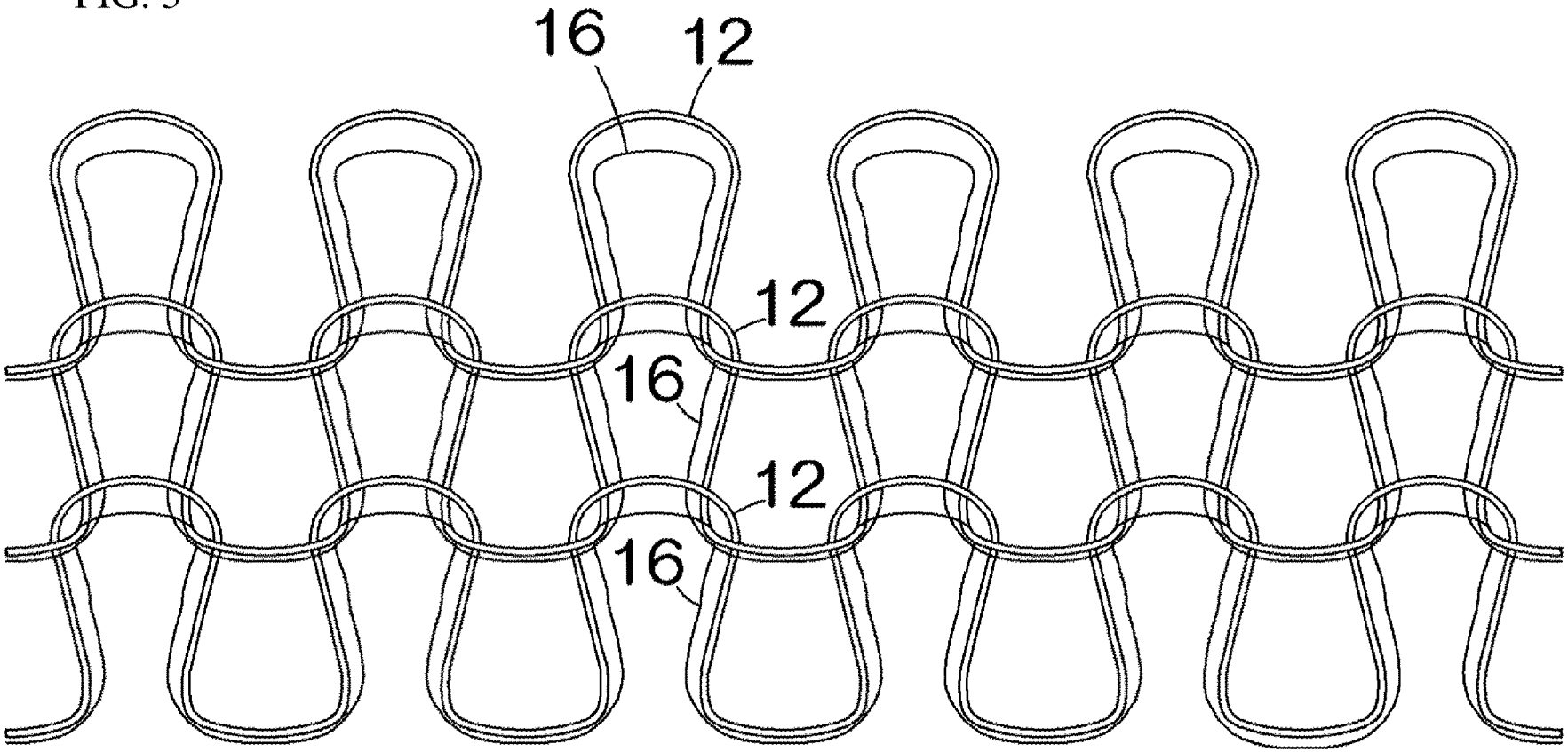
FIG. 3 is an enlarged view of stitches of a plain knitted fabric of the sock.

The stitches of the sock according to the present embodiment will be described next. FIG. 3 is an enlarged view of stitches of a plain knitted fabric of the sock according to an embodiment of the present invention. FIG. 4(*a*) is an enlarged view of stitches of a float knitted fabric of the sock, and FIG. 4(*b*) is a diagram showing a float boundary portion in the float knitted fabric of the sock. Here, in the plain knitted fabric shown in FIG. 3, and the float knitted fabric shown in FIG. 4(*a*), a horizontal row of loops will be referred to as a "course".

As described above, the slip preventing forefoot portion 11 of the sock 1 including the ball-of-foot portion 6 is knitted by plain knitting the polyurethane yarn 16. As used herein, plain knitting refers to a knitting method in which a polyurethane yarn 16 and a ground yarn 12 are knitted together such that the sinker loop length of the polyurethane yarn 16 and the sinker loop length of the ground yarn 12 are substantially the same (see FIG. 3). As described above, the slip preventing forefoot portion 11 of the sock 1 including the ball-of-foot portion 6 is knitted such that the polyurethane yarn 16 is knitted into a plurality of loops formed by the ground yarn 12 knitted into loops such that the sinker loop length of the polyurethane yarn 16 is substantially the same as the sinker loop length of the ground yarn 12.

As described above, because the ball-of-foot portion 6 of the sock 1 is plain knitted using the polyurethane yarn 16, the polyurethane yarn 16 on the outer surface of the sock prevents the sock from slipping on a shoe, a floor or the like. In addition thereto, because plain knitting is used in which the sinker loop length of the polyurethane yarn 16 and the sinker loop length of the ground yarn 12 are substantially the same, the polyurethane yarn 16 does not protrude too long in length toward the outside of the sock 1, and a good appearance can be obtained.

Figure 4A:
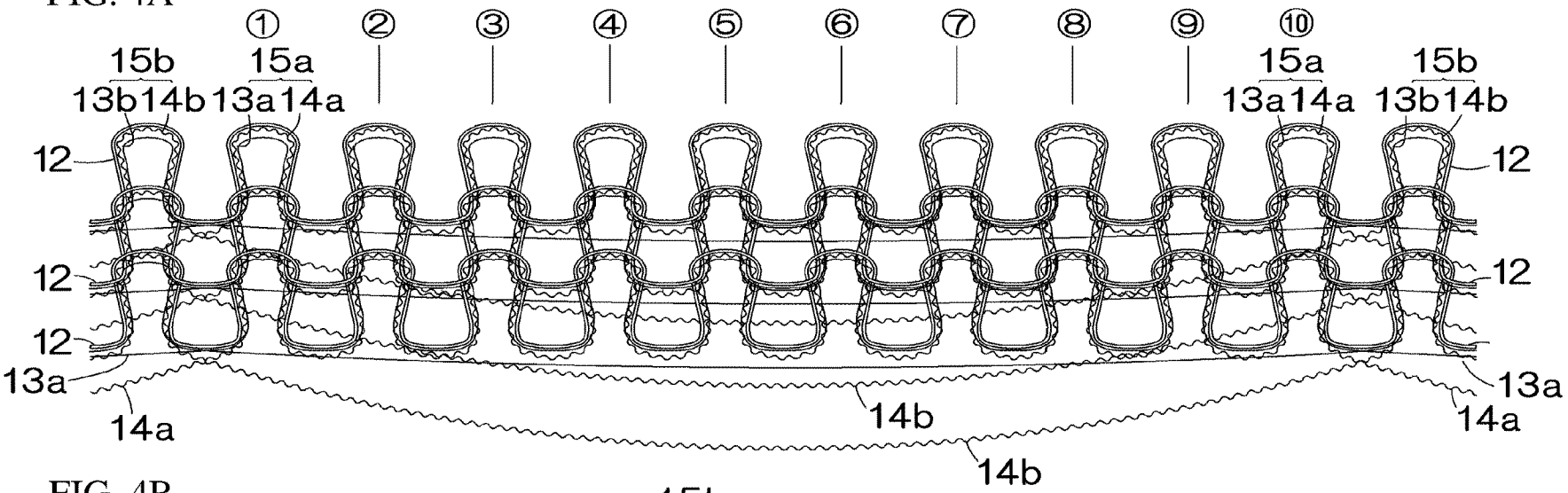
FIG. 4(*a*) is an enlarged view of stitches of a float knitted fabric of the sock.
Figure 4B:
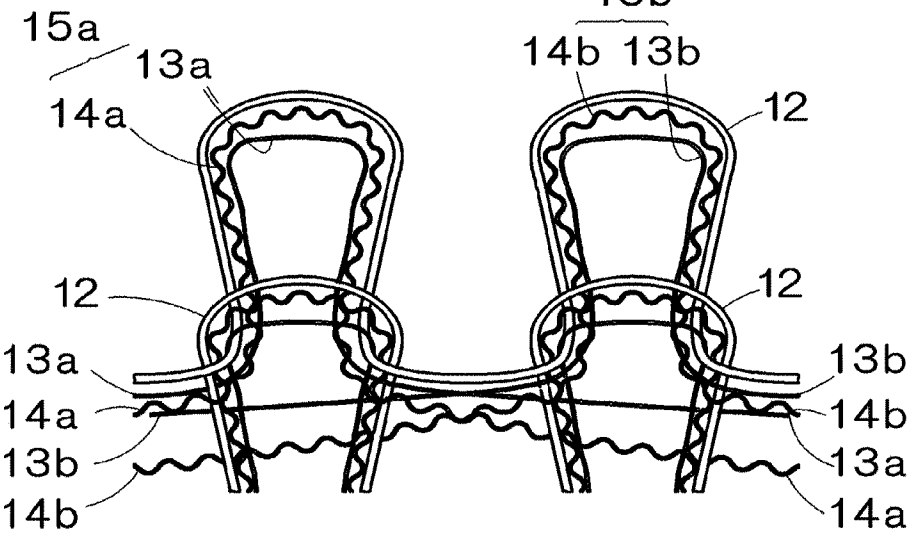

In the sole cushioning portion 10 of the sock 1, a first component yarn 15*a* composed of two yarns, namely, a woolly nylon yarn 13*a* and a cotton yarn 14*a*, and a second component yarn 15*b* composed of two yarns, namely, a woolly nylon yarn 13*b* and a cotton yarn 14*b*, are alternately knitted into float loops every 10 loops into a plurality of loops formed by a ground yarn 12 knitted into loops (see FIG. 4A). As used herein, loop knitting is a knitting method in which a yarn (a first component yarn 15*a* or a second component yarn 15*b*) composed of two yarns: a woolly nylon yarn 13*a* or 13*b*; and a cotton yarn 14*a* or 14*b* are knitted together with a ground yarn 12 such that the sinker loop length of the yarn (the first component yarn 15*a* or the second component yarn 15*b*) composed of two yarns: a woolly nylon yarn 13*a* or 13*b*; and a cotton yarn 14*a* or 14*b* is longer than the sinker loop length of the ground yarn 12. The present embodiment is configured such that the first component yarn 15*a* and the second component yarn 15*b* are alternately knitted into float loops every 10 loops, but the configuration is not limited thereto. The first component yarn 15*a* and the second component yarn 15*b* may be alternately knitted into float loops every plurality of loops such as every 4 loops, every 6 loops, or every 8 loops. Alternatively, the first component yarn 15*a* and the second component yarn 15*b* may be alternately knitted into float loops every loop. That is, the number of float loops alternately formed by the first component yarn 15*a* and the second component yarn 15*b* may be any number as long as the first component yarn 15*a* and the second component yarn 15*b* are alternately knitted into float loops. As described above, the first component yarn 15*a* and the second component yarn 15*b* are alternately knitted into float loops such that the second component yarn 15*b* does not float in the float loops of the first component yarn 15*a*, and the first component yarn 15*a* does not float in the float loops of the second component yarn 15*b*. Also, the woolly nylon yarn 13*a* or 13*b* is knitted, together with the cotton yarn 14*a* or 14*b*, into float loops every 10 loops, but is disconnected (cut) at a portion of a floating portion. Because the woolly nylon yarn 13*a* or 13*b* is disconnected at a portion of a floating portion as described above, the woolly nylon yarn 13*a* or 13*b* can be more easily intertwined with the cotton yarn 14*a* or 14*b*, and it is possible to further prevent the cotton yarn 14*a* or 14*b* from being pulled to the outer side of the sock.

Figure 5:
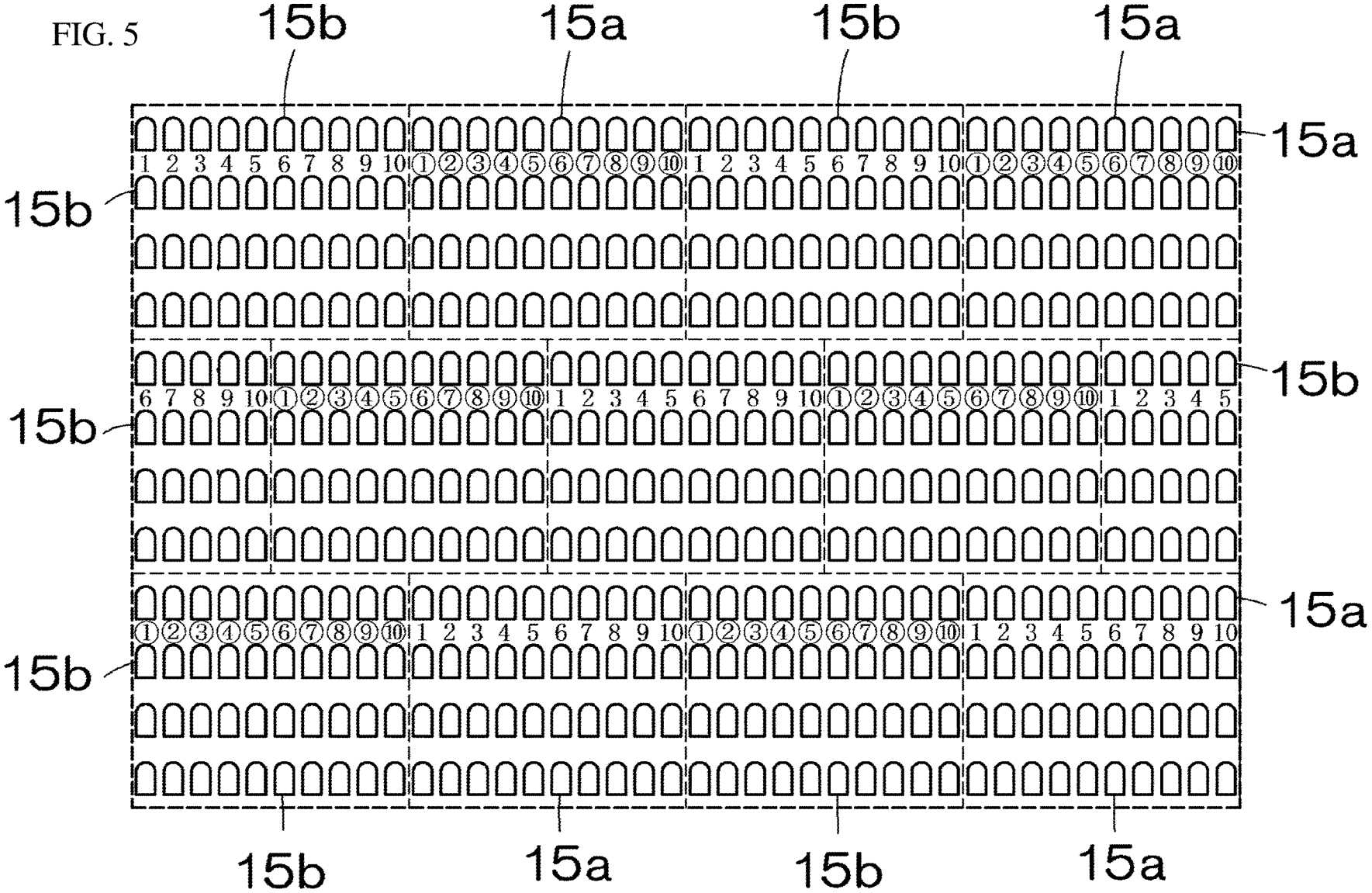
FIG. 5 is a diagram showing a positional relationship between a first component yarn and a second component yarn on the sock surface in a sole cushioning portion of the sock.

As described above, the sole cushioning portion 10 of the sock 1 is knitted such that a first component yarn 15*a* composed of two yarns, namely, a woolly nylon yarn 13*a* and a cotton yarn 14*a*, and a second component yarn 15*b* composed of two yarns, namely, a woolly nylon yarn 13*b* and a cotton yarn 14*b*, are alternately knitted into float loops every 10 loops into a plurality of loops formed by a ground yarn 12 knitted into loops. However, the first component yarn 15*a* and the second component yarn 15*b* are knitted with an offset of 5 loops every 4 courses (see FIG. 5). That is, when the first component yarn 15*a* and the second component yarn 15*b* have been knitted to form 4 courses, the first component yarn 15*a* and the second component yarn 15*b* are knitted to form courses while offsetting the stitches knitted using the first component yarn 15*a* and the second component yarn 15*b* by 5 loops in the course direction. Then, when another 4 courses have been formed by knitting the first component yarn 15*a* and the second component yarn 15*b* with an offset of 5 loops, the first component yarn 15*a* and the second component yarn 15*b* are knitted to form courses while offsetting the stitches knitted using the first component yarn 15*a* and the second component yarn 15*b* by 5 loops backwards in the course direction. The sole cushioning portion 10 of the sock 1 is knitted by repeating this process. Here, FIG. 5 is a diagram showing a positional relationship between the first component yarn and the second component yarn on the sock surface in the sole cushioning portion of the sock according to an embodiment of the present invention. In the present embodiment, the first component yarn 15*a* and the second component yarn 15*b* are knitted with an offset of 5 loops every 4 courses. However, the configuration is not limited thereto. The first component yarn 15*a* and the second component yarn 15*b* may be knitted with an offset of 5 loops every 6 courses. Alternatively, the first component yarn 15*a* and the second component yarn 15*b* may be knitted with an offset of a predetermined number of loops every predetermined number of courses such as with an offset of 5 loops every 2 to 8 courses (preferably every 4 to 8 courses (more preferably every 4 to 6 courses)).

Figure 6:
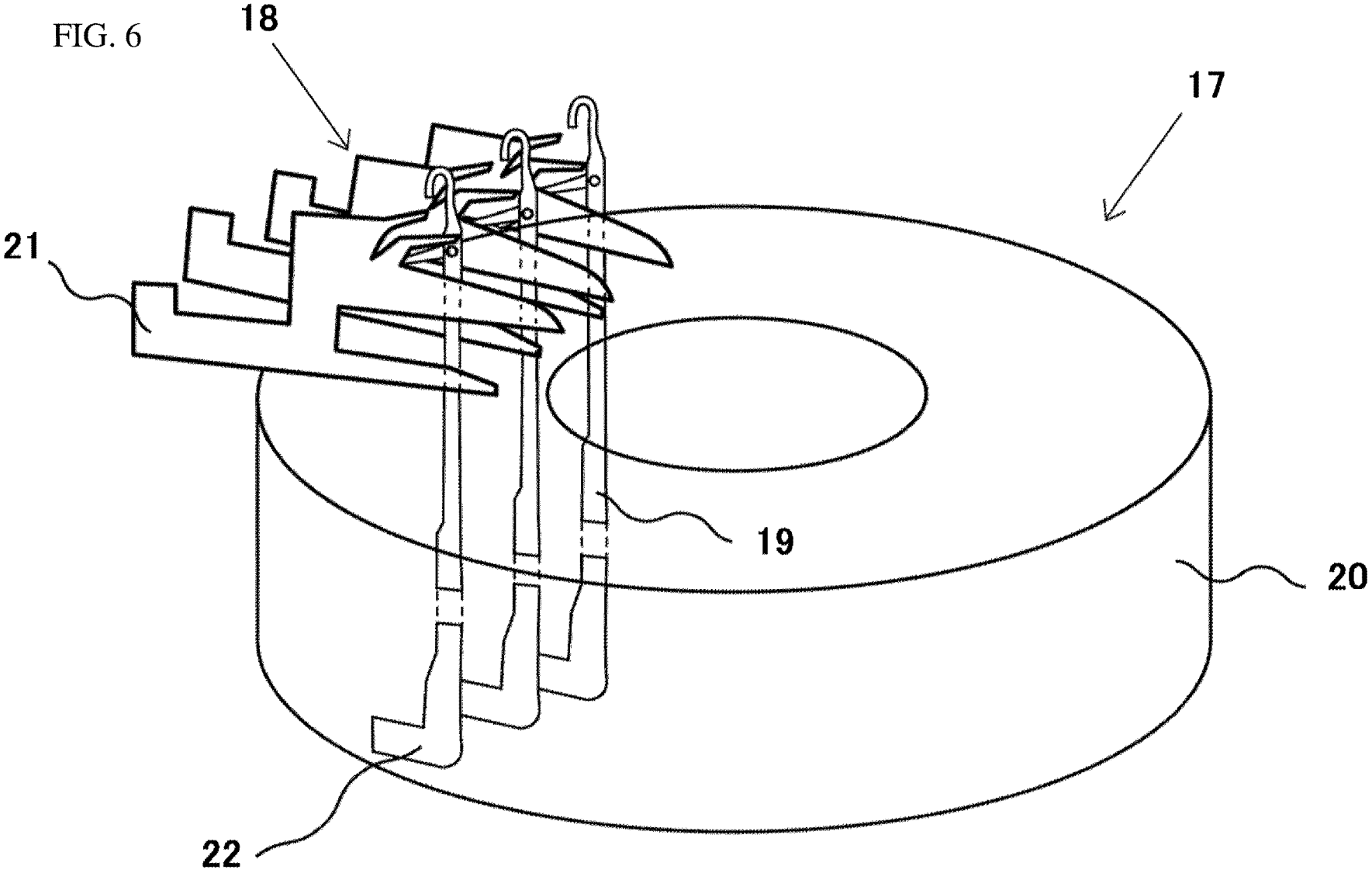
FIG. 6 is a schematic diagram of a circular knitting machine for producing a sock according to an embodiment of the present invention.
Figure 7:
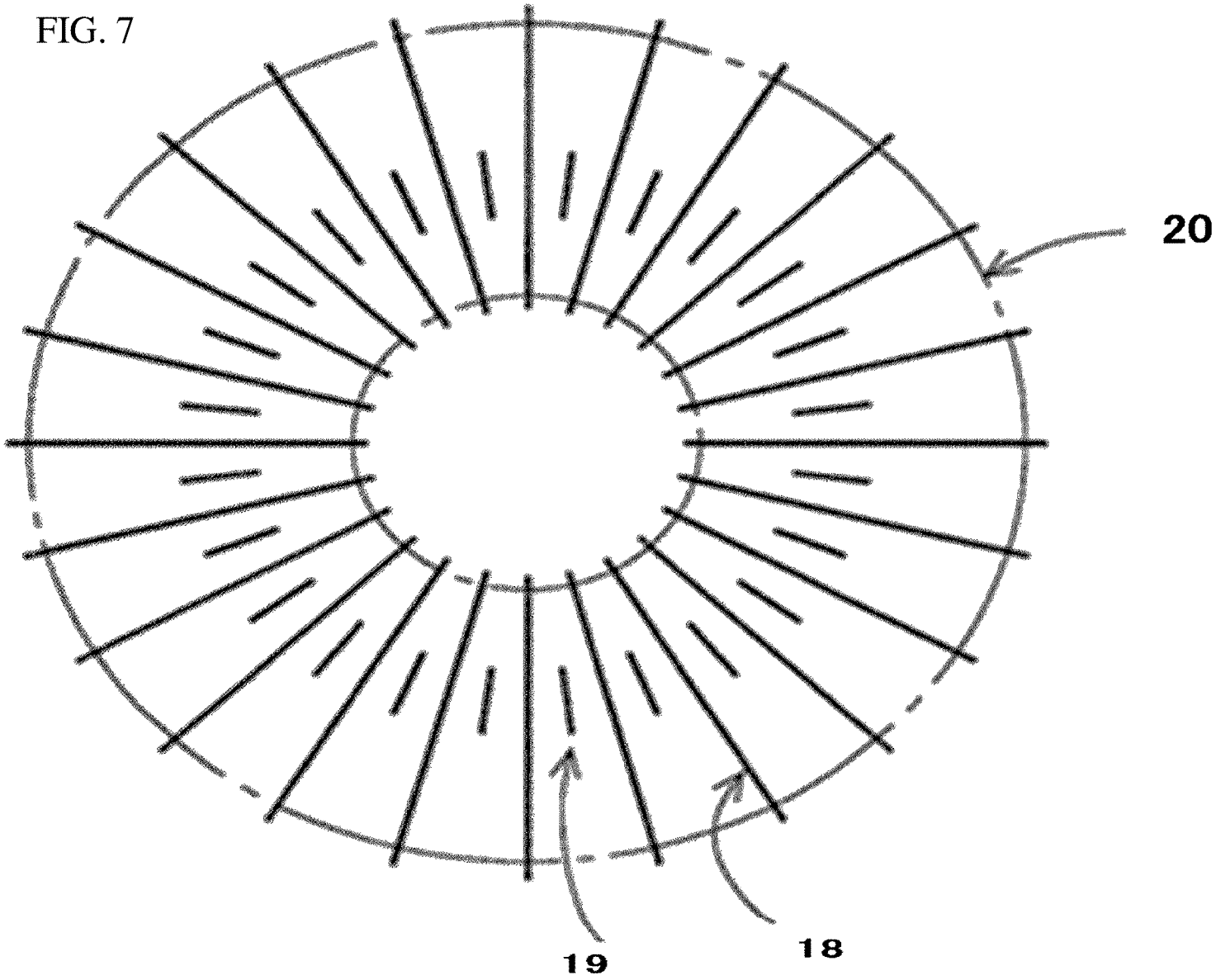
FIG. 7 is a plan view of the circular knitting machine shown in FIG. 6.
Figure 8:
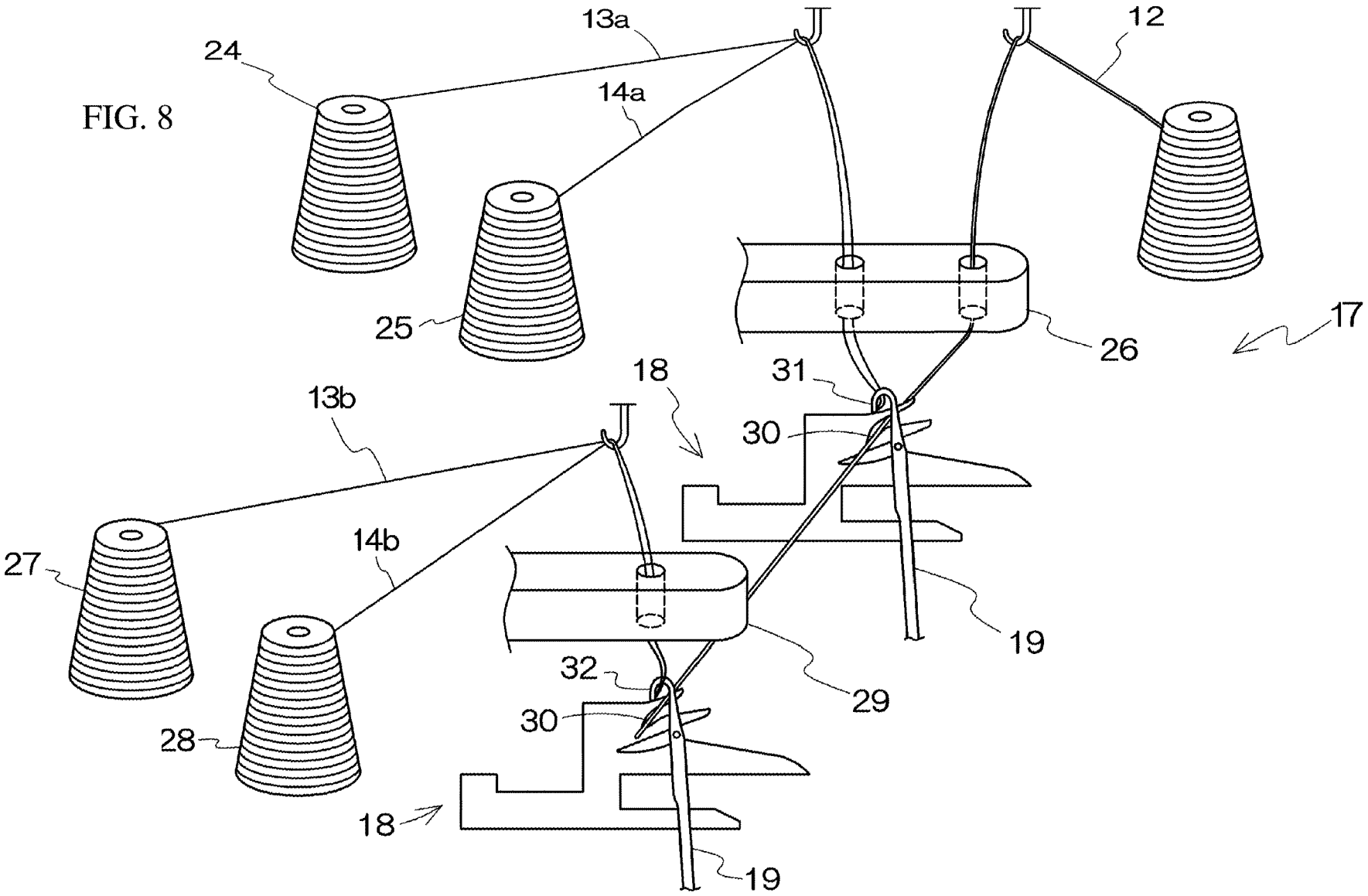
FIG. 8 is a schematic diagram illustrating how yarns are supplied to the circular knitting machine.
Figure 9:
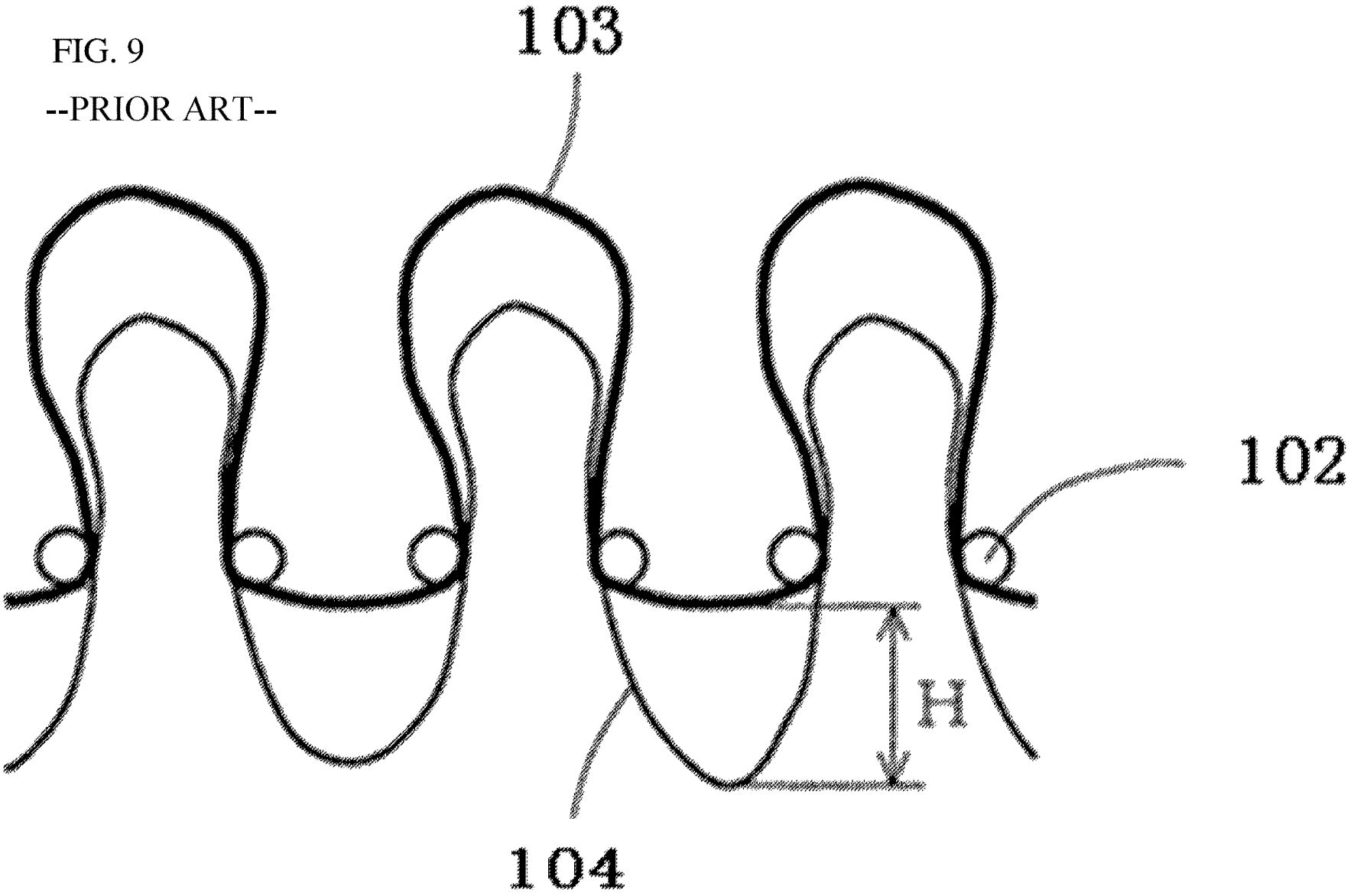
FIG. 9 is a diagram showing construction of a conventional sock.

A method for knitting a sock according to the present embodiment will be described next with reference to FIGS. 6 to 8. FIG. 6 is a schematic diagram of a circular knitting machine for producing a sock according to an embodiment of the present invention, FIG. 7 is a plan view of the circular knitting machine shown in FIG. 6, and FIG. 8 is a schematic diagram illustrating how yarns are supplied to the circular knitting machine.

In a circular knitting machine 17, a plurality of circumferentially equidistantly spaced sinkers 18, and knitting needles 19 that are each provided between adjacent sinkers 18 are slidably supported by a cylinder member 20 that has a cylindrical shape (see FIG. 6). The sinkers 18 reciprocally slide in the radial direction, and the knitting needles 19 reciprocally slide in the vertical direction. Yarns are supplied to the knitting mechanism portion, and a sock 1 is knitted by combining reciprocal sliding of the sinkers 18 in the radial direction and reciprocal sliding of the knitting needles 19 in the vertical direction.

Specifically, a ring-shaped metal cap (not shown) is disposed in the vicinity of the upper surface of the cylinder member 20, and sinker paths (not shown) that have a substantially annular groove-like shape are formed on the underside of the cap. Also, a cam mechanism (not shown) that includes a lifting cam and a lowering cam is disposed in the vicinity of the side surface of the cylinder member 20. The cylinder member 20 is rotated by a driving mechanism (not shown), but the cap and the cam mechanism are not rotated.

A butt 21 formed in a radially outward end portion of each sinker 18 is positioned in a sinker path on the underside of the cap, and a butt 22 formed in a lower end portion of each knitting needle 19 is exposed to the outside from the side surface of the cylinder member 20, and engages with the cam mechanism. Accordingly, when the cylinder member 20 is rotated by the driving mechanism (not shown), each sinker 18 reciprocally slides while being guided by a sinker path, and each knitting needle 19 reciprocally slides while being guided by the cam mechanism.

With the circular knitting machine 17 as described above, the sock 1 is knitted into a tubular shape from a sock opening 23 (see FIG. 1) toward the toe portion 7, and the heel portion 4 and the toe portion 7 are knitted using the reciprocal rotation function of the circular knitting machine 17. Then, the toe portion 7 and the instep portion 3 are sewed together through linking, tow sewing, or the like.

The sole cushioning portion 10 of the sock bottom portion 9 is loop-knitted in the manner described below. To be specific, as shown in FIG. 8, a ground yarn 12, woolly nylon yarns 13*a* and 13*b*, and cotton yarns 14*a* and 14*b* are supplied from respective rolls to the knitting mechanism portion. More specifically, the woolly nylon yarn 13*a* and the cotton yarn 14*a* are conveyed to a yarn path 26 from cylindrical core members 24 and 25, which are rolls around which the woolly nylon yarn 13*a* and the cotton yarn 14*a* are wound respectively, and supplied to a second receiving portion 31 of a sinker 18. Likewise, the woolly nylon yarn 13*b* and the cotton yarn 14*b* are conveyed to a yarn path 29 from cylindrical core members 27 and 28, which are rolls around which the woolly nylon yarn 13*b* and the cotton yarn 14*b* are wound respectively, and supplied to a third receiving portion 32 of a sinker 18. Meanwhile, the ground yarn 12 is supplied from a roll to first receiving portions 30 of the sinkers 18 via the yarn path 26.

Then, vertically moving knitting needles 19 draw: the woolly nylon yarn 13*a*, the cotton yarn 14*a*, and the ground yarn 12; and the woolly nylon yarn 13*b*, the cotton yarn 14*b*, and the ground yarn 12, respectively, and as a result of the sinkers 18 sliding in a radially outward direction, the ground yarn 12 is formed into loops, and the woolly nylon yarn 13*a* and the cotton yarn 14*a*, and the woolly nylon yarn 13*b* and the cotton yarn 14*b* are alternately knitted into float loops every 10 loops of the ground yarn 12. The sinker loop lengths of loop knitting are determined by the distance between the first receiving portion 30 and the second receiving portion 31, and the distance between the first receiving portion 30 and the third receiving portion 32.

The woolly nylon yarn 13*a* forms loops as does the cotton yarn 14*a*, but because the woolly nylon yarn 13*a* is elastic, the sinker loop length of the woolly nylon yarn 13*a* is smaller than the sinker loop length of the cotton yarn 14*a*. In addition, the cotton yarn 14*a* also forms irregular loops on a side opposite to the side on which loops are formed. The sock 1 according to the present embodiment makes a positive use of the loops of the cotton yarn 14*a* formed on the side opposite to the side on which the loops of the ground yarn 12 are formed to improve cushioning properties.

As described above, the slip preventing forefoot portion 11 including the ball-of-foot portion 6 is plain knitted. The plain knitting used to knit the slip preventing forefoot portion 11 can be easily understood based on the loop knitting used to knit the sole cushioning portion 10 of the sock bottom portion 9, and thus a description of the plain knitting is omitted here. The slip preventing forefoot portion 11 is plain knitted such that all of the loops are formed by knitting the polyurethane yarn 16 and the ground yarn 12 together, without using the woolly nylon yarn 13 and the cotton yarn 14.

As described above, the first component yarn 15*a* composed of two yarns, namely, the woolly nylon yarn 13*a* and the cotton yarn 14*a*, and the second component yarn 15*b* composed of two yarns, namely, the woolly nylon yarn 13*b* and the cotton yarn 14*b* are alternately knitted into float loops every 10 loops. Accordingly, the cotton yarns 14*a* and 14*b* that are less stretchable appear on the surface, and thus cushioning properties can be improved. Also, the yarn strength can be increased by the woolly nylon yarn 13*a* that is highly stretchable, and also the strength can be further increased by using the component yarns each composed of two yarns: the woolly nylon yarn 13*a* (13*b*); and the cotton yarn 14*a* (14*b*). Accordingly, the obtained sock can be used for a long period of time. In addition, because the first component yarn 15*a* composed of two yarns, namely, the woolly nylon yarn 13*a* and the cotton yarn 14*a*, and the second component yarn 15*b* composed of two yarns, namely, the woolly nylon yarn 13*b* and the cotton yarn 14*b* are knitted into float loops alternately every 10 loops, the cotton yarn 14*a* that is less stretchable protrudes on the inner side of the sock 1, and it is therefore possible to prevent the sock from slipping on the sole of a foot. Accordingly, the sock 1 can exhibit cushioning properties obtained by pile knitting in a region that is not pile knitted, and thus can be used for a long period of time even when the sock 1 is used by a factory worker or the like.

The embodiment disclosed above should be considered as illustrative and not restrictive in all respects. The scope of the present invention is defined by the appended claims rather than the forgoing description, and all changes that come within the meaning and range of equivalency of the claims are intended to be embraced in the scope of the present invention.

What is claimed is:

1. A sock comprising: a plurality of loops of a woolly-processed yarn knitted into a plurality of loops of a ground yarn, wherein the sock comprises a sock bottom portion, and the sock bottom portion comprises a sole cushioning portion, wherein the sole cushioning portion is knitted such that two pairs of component yarns are alternately knitted into floating portions every plurality of loops into the plurality of loops of the ground yarn, the two pairs of component yarns being a first component yarn and a second component yarn, each of the first component yarn and the second component yarn is composed of a first yarn made from the woolly-processed yarn; and a second yarn made from a cellulose fiber yarn, a hemp yarn, a silk yarn, animal hair, or an acrylic yarn, wherein the first component yarn and the second component yarn are alternately knitted into the floating portions every 10 loops.

2. The sock according to claim 1, wherein the first component yarn and the second component yarn are knitted with an offset of 5 loops every predetermined number of courses.

3. The sock according to claim 1, wherein the second yarn is made from the cellulose fiber yarn, and the cellulose fiber yarn is a cotton yarn.

4. The sock according to claim 1, wherein the second yarn is made from the cellulose fiber yarn, and the cellulose fiber yarn is a viscose rayon fiber or a cuprammonium rayon fiber.

5. The sock according to claim 1, wherein the woolly-processed yarn is a woolly nylon yarn or a polyester yarn.

6. The sock according to claim 1, wherein the sock further comprises a ball-of-foot portion, and the ball-of-foot portion is knitted through plain knitting in which only a rubber-based fiber yarn is knitted into the plurality of loops of the ground yarn.

7. The sock according to claim 6, wherein the rubber-based fiber yarn is a polyurethane yarn.

* * * * *